US005978963A

United States Patent [19]

Moskowitz et al.

[11] Patent Number: 5,978,963

[45] Date of Patent: Nov. 9, 1999

[54] SLENDERIZING SWIMSUIT

[76] Inventors: Leib Moskowitz; Yenty Moskowitz, both of 198 Wilson St. #4F, Brooklyn, N.Y. 11211

[21] Appl. No.: 08/654,076

[22] Filed: May 28, 1996

[51] Int. Cl.[6] ..... A41C 1/08; A41D 7/00

[52] U.S. Cl. ..... 2/67; 2/73; 450/95

[58] Field of Search ..... 450/95, 7, 15, 450/16, 22, 113, 115, 129; 2/67, 69, 70, 71, 72, 73, 76, 221, 237

[56] References Cited

U.S. PATENT DOCUMENTS

| | | | |
|---|---|---|---|
| Re. 33,406 | 10/1990 | Wier | 2/67 |
| 3,023,419 | 3/1962 | Strahle | 2/67 X |
| 3,068,871 | 12/1962 | Rapp | 450/95 |
| 3,127,896 | 4/1964 | Puliafico | 2/227 |
| 3,333,589 | 8/1967 | Cohen et sl. | 450/95 |
| 4,069,513 | 1/1978 | Shiller et al. | 2/227 |
| 4,184,494 | 1/1980 | King, Jr. | 2/67 C |
| 4,398,538 | 8/1983 | Johnson | 2/67 X |
| 5,033,986 | 7/1991 | Feigenbaum et al. | 2/67 X |
| 5,478,278 | 12/1995 | Greenblatt | 2/67 X |

*Primary Examiner*—Jeanette E. Chapman

[57] ABSTRACT

A slenderizing swimsuit including a body covering that has an upper torso portion and a lower torso portion. The lower torso portion has a front portion, a rear portion and side portions that are interconnected. The lower torso portion has a pair of leg openings that are formed in each side portion. Lastly, a girdle is attached to an inside portion of the lower torso portion. The girdle has a front panel, a rear panel and a crotch interconnecting the front and rear panels. The girdle has a first side panel and a second side panel. The first side panel is interconnected with the front and rear panels. The second side panel has first and second edges that are capable of coupling one to the other.

1 Claim, 2 Drawing Sheets

SLENDERIZING SWIMSUIT

BACKGROUND OF THE INVENTION

1. Field of the Invention

The present invention relates to a slenderizing swimsuit and more particularly pertains to providing a lower torso portion that has a multi-panel structure for containing the midriff of a wearer, and further having a mechanism for adjusting the multi-panel structure to the physical needs of the wearer.

2. Description of the Prior Art

The use of a girdle is known in the prior art. More specifically, girdles heretofore devised and utilized for the purpose of supporting the body are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,628,930 to Williams discloses a soothing comfort girdle. U.S. Pat. No. 4,205,397 to Bechis discloses bathing drawers. U.S. Pat. No. Des. 258,770 to Stern discloses a girdle. U.S. Pat. No. 4,928,323 to Nathan discloses a garments and parts thereof. U.S. Pat. No. 4,133,054 to Harper discloses a lower body garment and method. Lastly, U.S. Pat. No. 4,000,746 to Fierst discloses a girdle construction.

While these devices fulfill their respective, particular objectives and requirements, the aforementioned patents do not describe slenderizing swimsuit that allows the multi-panel structure to function as a girdle, when it is attached to the inside area of the body covering at the lower torso portion, and the girdle being adjustable with a hook-type fastener mechanism.

In this respect, the slenderizing swimsuit according to the present invention substantially departs from the conventional concepts and designs of the prior art, and in doing so provides an apparatus primarily developed for the purpose of providing a lower torso portion that has a multi-panel structure for containing the midriff of a wearer, and further having a mechanism for adjusting the multi-panel structure to the physical needs of the wearer.

Therefore, it can be appreciated that there exists a continuing need for a new and improved slenderizing swimsuit which can be used for providing a lower torso portion that has a multi-panel structure for containing the midriff of a wearer, and further having a mechanism for adjusting the multi-panel structure to the physical needs of the wearer. In this regard, the present invention substantially fulfills this need.

SUMMARY OF THE INVENTION

In view of the foregoing disadvantages inherent in the known types of girdles now present in the prior art, the present invention provides an improved slenderizing swimsuit. As such, the general purpose of the present invention, which will be described subsequently in greater detail, is to provide a new and improved slenderizing swimsuit and method which has all the advantages of the prior art and none of the disadvantages.

To attain this, the present invention essentially comprises a body covering being formed from a single piece of elasticized material. The body covering has an upper torso portion and a lower torso portion. The upper torso portion has a pair of straps that support the body covering over the shoulders of a wearer. Each strap is integral an upper edge of a front and back portion of the upper torso portion. The lower portion has a front portion, a rear portion and a side portion that are interconnected. The lower torso portion has a pair of leg openings that are formed in each side portion. Included is a girdle that has a front panel, a rear panel and a crotch interconnecting the front and rear panel. The girdle has a first side panel and a second side panel. The first side panel is interconnected with the front and rear panel. The second side panel has a first and second edge with each edge capable of coupling one to the other. The first and second edge being coupled by a zipper mechanism to secure the girdle about the lower torso of the wearer. Included is a hook-type fastening mechanism with a hook member and an eye member. The hook and eye member are each attached to the second side panel of the girdle. The hook-type fastening mechanism will adjust the tightness of the front and rear panel around the body, when the girdle is worn, and prior to the fastening of the first and second edge with the zipper mechanism. Lastly, the girdle is stitchedly attached to a crotch panel of the body covering and the leg openings of an inside portion of the lower torso portion. The first and second edge of the second side panel of the girdle are free when the hook and eye member are coupled. The hook-type fastener is accessible from under the body covering for adjusting the front and rear panel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved slenderizing swimsuit which has all of the advantages of the prior art a girdle and none of the disadvantages.

It is another object of the present invention to provide a new and improved slenderizing swimsuit which may be easily and efficiently manufactured and marketed.

It is further object of the present invention to provide a new and improved slenderizing swimsuit which is of durable and reliable constructions.

An even further object of the present invention is to provide a new and improved slenderizing swimsuit which is susceptible of a low cost of manufacture with regard to both materials and labor, and which accordingly is then susceptible of low prices of sale to the consuming public, thereby making such slenderizing swimsuit economically available to the buying public.

Still yet another object of the present invention is to provide a new and improved slenderizing swimsuit which provides in the apparatuses and methods of the prior art some of the advantages thereof, while simultaneously overcoming some of the disadvantages normally associated therewith.

Even still another object of the present invention is to provide a slenderizing swimsuit for providing a lower torso portion that has a multi-panel structure for containing the midriff of a wearer, and further having a mechanism for adjusting the multi-panel structure to the physical needs of the wearer.

Lastly, it is an object of the present invention to provide a new and improved slenderizing swimsuit including a body covering that has an upper torso portion and a lower torso portion. The lower torso portion has a front portion, a rear portion and side portions that interconnected. The lower torso portion has a pair of leg openings that are formed in each side portion thereof. Lastly, a girdle is attached to an inside portion of the lower torso portion. The girdle has a front panel, a rear panel and a crotch interconnecting the front and rear panels. The girdle has a first side panel and a second side panel. The first side panel is interconnected with the front and rear panels. The second side panel has first and second edges that are capable of coupling one to the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
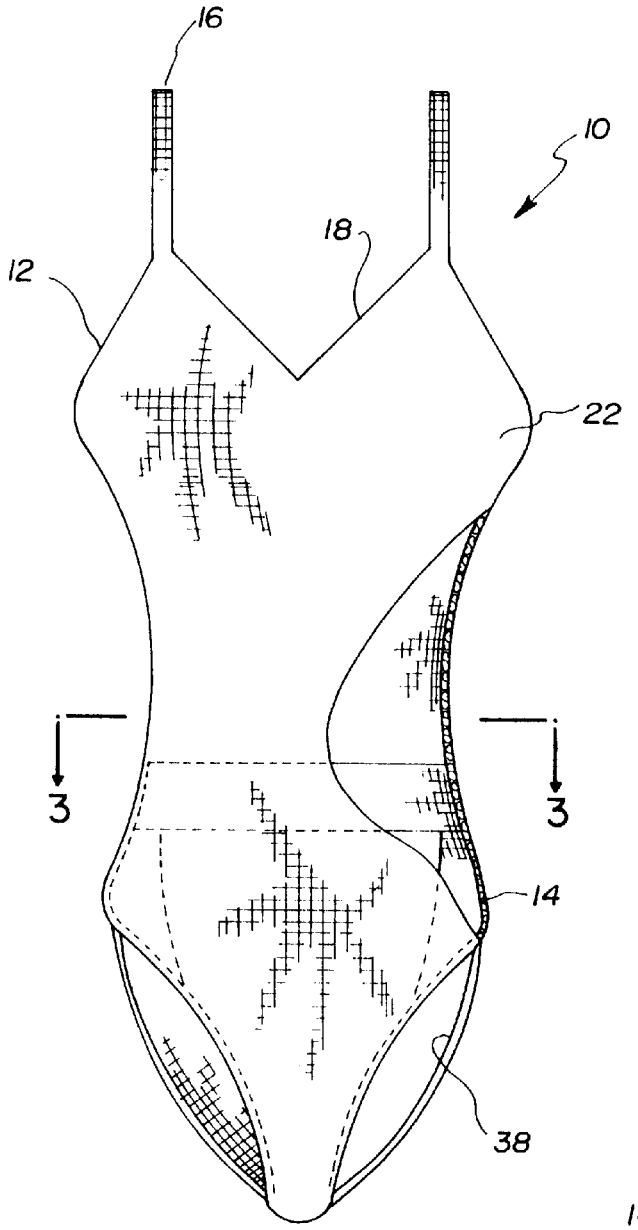
FIG. 1 is a frontal view of the preferred embodiment of the slenderizing swimsuit constructed in accordance with the principles of the present invention.
Figure 5:
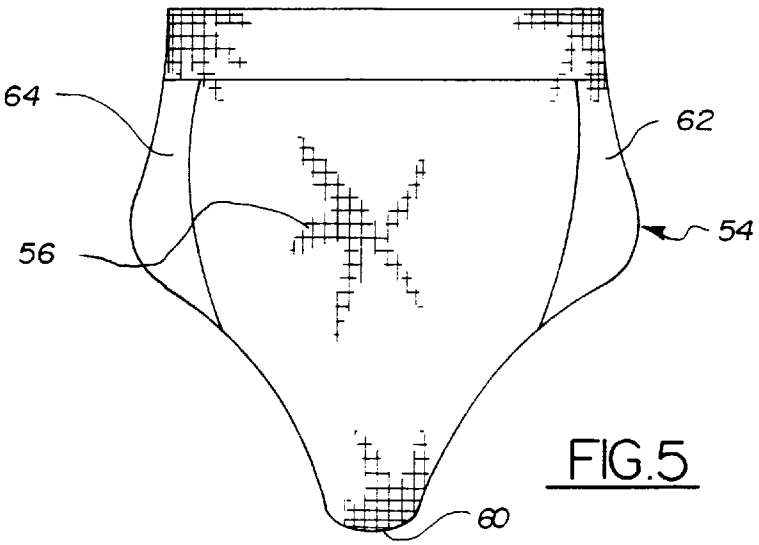
FIG. 5 is a frontal view of the girdle of the present invention of FIGS. 1 and 2.

With reference now to the drawings, and in particular to FIGS. 1 and 5 thereof, the preferred embodiment of the new and improved slenderizing swimsuit embodying the principles and concepts of the present invention and generally designated by the reference numeral 10 will be described.

The present invention, the slenderizing swimsuit 10 is comprised of a plurality of components. Such components in their broadest context include a body cover and a girdle. Such components are individually configured and correlated with respect to each other so as to attain the desired objective.

Figure 2:
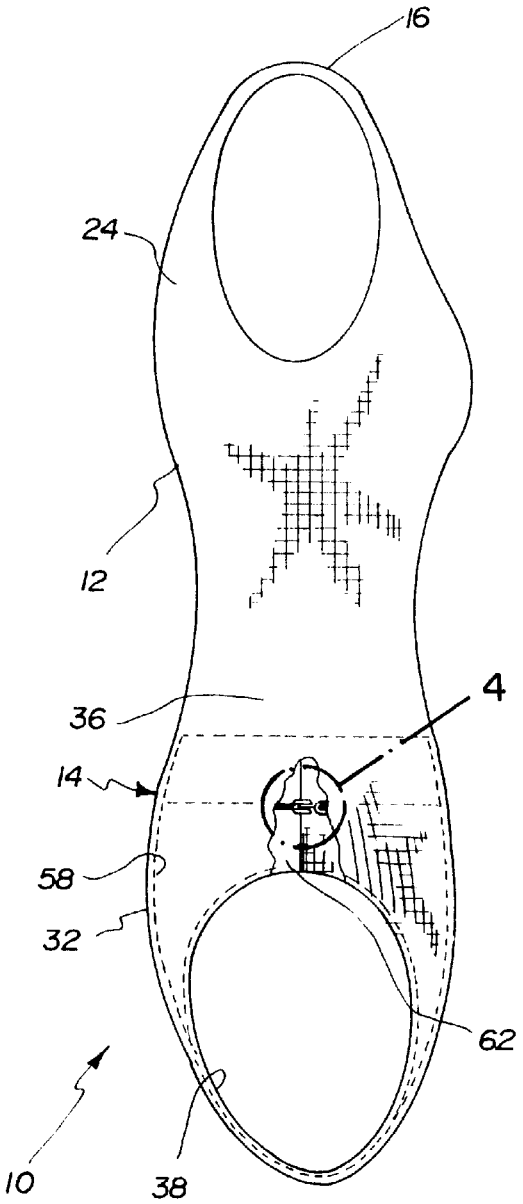
FIG. 2 is a side elevational view of the present invention of FIG. 1.

Specifically, the present invention includes a body covering 10 formed from a single piece of elasticized material. Preferably, nylon is the material used, but any other fabric currently being used to make conventional swimsuits may be used. The body covering or swimsuit is structured to cover the torso of a swimmer. The body covering has an upper torso portion 12 and a lower torso portion 14. The upper torso portion, as seen in FIGS. 1 and 2, has a pair of straps 16 for supporting the body covering over the shoulders of a wearer. Each strap is integral an upper edge 18 of a front 22 and back 24 portion of the upper torso portion.

Figure 3:
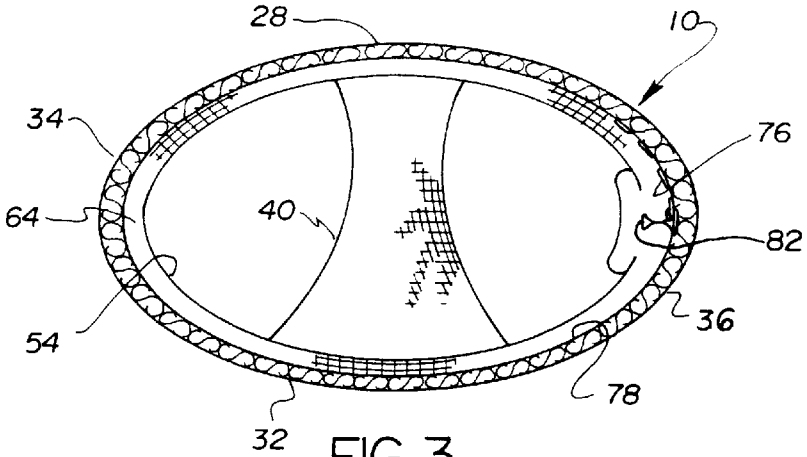
FIG. 3 is a cross sectional view of the present invention taken along line 3—3 of FIG. 1.

As best illustrated in FIG. 3, the lower torso portion 14 has a front portion 28, a rear portion 32 and side portions 34 and 36 that are interconnected. The lower torso portion has a pair of leg openings 38 that are formed in each side portion. The leg openings have a crotch panel 40 as shown in FIG. 3. Also, in order to give a more attractive appearance, the leg openings have a french cut. The present invention, though showing the french cut is not limited to having the leg openings formed in this manner.

Figure 6:
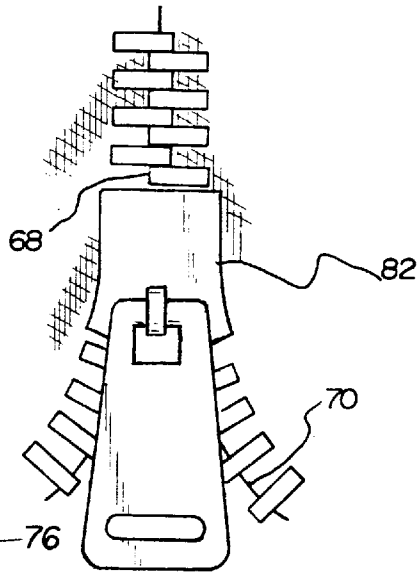
FIG. 6 is an enlarged view of the zipper fastener of the girdle of the present invention of FIGS. 1 and 2.

A girdle 54 is provided. The girdle of FIG. 5 is preferably formed of neoprene or spandex. The girdle has a front panel 56, a rear panel 58 and a crotch 60 interconnecting the front and rear panels. The girdle has a first side panel 64 and a second side panel 62. The first side panel is connected with the front an rear panels of the girdle, as seen in FIG. 3. The second side panel has a first edge 68 and a second edge 70, with each edge capable of coupling one to the other as seen in FIG. 6. The first edge and the second edge are capable of being folded inward.

The first and second edge may fold inward, when coupled, when a hook-type fastener mechanism 72 is engaged by the wearer. The hook-type fastener mechanism has a hook member 74 spaced from the first edge and a plurality of eye members spaced from the second edge of the second panel. The hook member is capable of coupling to any one of a plurality of eye members 76, that are attached to the second side panel. The hook-type fastener mechanism is used to adjust the tightness of the front and rear panels around the body when the body covering is worn. The swimsuit wearer pulls the front and rear panels as tight as needed, then chooses from one of the plurality of eye members, as seen in FIG. 2, to couple the hook-type fastener onto.

Figure 4:
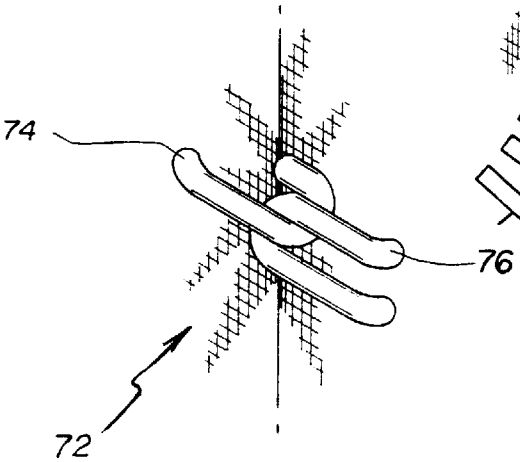
FIG. 4 is an enlarged view of the hook-type fastener of the present invention taken at position 4 of FIG. 2.

Lastly, as seen in FIGS. 1 and 2, the girdle is worn under the swim suit. The girdle is stitchedly attached to the crotch panel 40 and the leg openings 38 of an inside portion 78 of the lower torso portion 14. The body covering will hang from the girdle along the crotch and leg openings when the girdle is first pulled onto the wearer. The first and second edge of the side panel remain coupled when the hook-type fastener is coupled in the manner shown in FIG. 4. When coupled, the hook-type fastener pulls inward the lower torso of the wearer by pulling the front and rear panel of the girdle therearound. Whereby, the body covering hangs down from the girdle to allow access to the hook-type fastener to adjust the front and rear panels.

Furthermore, as shown in FIG. 6, a zipper mechanism 82 is included. The zipper mechanism would be attached at the first edge 68 and the second edge 70 of the second side panel, as seen in FIG. 3. Once the zipper secures the first and second edge together the hook-type fastener may be hooked and allow portions of the side panel to overlap the zipper as seen in FIG. 3. Once the hook-type fastener is coupled, the present invention is firmly secured around the hips and waist of the wearer by the zipper. If the hook-type fastener becomes uncoupled, the zipper will retain the girdle around the lower torso of the wearer. The body covering is then pulled up over the torso after the hooks and zipper are fastened.

When the hook is coupled, the wearer is given the appearance of having a slimmer and fit midriff. Because the swimsuit will be worn in the water, the zipper mechanism of FIG. 6 is a plastic zipper. The zipper mechanism is capable of opening a distance above one of the leg openings of the swimsuit. The zipper mechanism is capable of closing the second side panel, linearly the lower torso portion and flush the upper portion of the one leg opening. When the zipper is opened, the girdle is loosely positioned around the hips and abdomen of the wearer until the hook-type fasteners are engaged.

The present invention is a slenderizing swimsuit that is comfortable when worn by the wearer. The body covering of the swimsuit is shaped and structured like many commercially available swimsuits. In the present invention the swimsuit, as shown, is to be worn by a female. Attached to a lower torso portion of the swimsuit is a girdle. The girdle has two fastening mechanisms along a side panel thereof.

The fastening mechanisms of the girdle are hook and eye-type fastening mechanism and a zipper. The hook and eye-type fastening mechanism allows the girdle to be adjusted. The zipper help to retain the retaine the girdle in position once the hook-type fastening mechanism has been engaged. The zipper is coupled a first and second edge a side panel. Each of the fastening mechanisms of the present invention allow the swimsuit wearer to easily pull the girdle over the lower torso of the body first. Once the girdle is in position the body covering/swimsuit is pulled up. It is to be noted that the swimsuit of the present invention can come in a variety of sizes and colors. Also, the girdle may be placed in a swimsuit for males. Either swimsuit type can be available in a variety of materials which can be thick or thin depending upon what is commercially feasible and marketable. The present invention is good at hiding extra fat in the stomach, hips and back area. The present invention is structured so that the wearer, when viewed by someone else, does not have the appearance of having an additional girdle under the swimsuit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved slenderizing swim suit for firmly supporting the abdominal and lower back area of a body comprising in combination:

a body covering being formed from a single piece of elasticized material, the body covering having an upper torso portion and a lower torso portion, the upper torso portion having a pair of straps for supporting the body covering over the shoulders of a wearer, each strap being integral to an upper edge of a front and back portion of the upper torso portion;

the lower torso portion having a front portion, a rear portion and side portions being interconnected, the lower torso portion having a pair of leg openings being formed in each side portion thereof;

a girdle having a front panel, a rear panel and a crotch interconnecting the front and rear panel, the girdle having a first side panel and a second side panel, the first side panel being interconnected with the front and rear panel, the second side panel having a first and second edge capable of folding inwardly towards each other, the first and second edge being coupled by a zipper mechanism for securing the girdle about the lower torso of the wearer;

a hook-type fastener mechanism having a hook member being spaced from the first edge of the second panel and an eye member being spaced from the second edge of the second panel, the hook member and the eye member being attached to the second side panel of the girdle, the hook-type fastening mechanism being capable of adjusting the tightness of the front and rear panel around the body when the girdle being worn, and after the fastening of the first and second edge with the zipper mechanism; and the girdle being stitchedly attached to a crotch panel of the body covering and the leg openings of an inside portion of the lower torso portion, the first and second edge of the second side panel of the girdle being coupled by the zipper mechanism prior to the hook and eye member of the hook-type fastener mechanism being coupled, the hook-type fastener member being coupled will cause portions of the side panel to over lap the zipper mechanism, the hook-type fastener being accessible from under the body covering for adjusting the front and rear panel.

* * * * *